United States Patent [19]

Knecht

[11] 4,408,816

[45] Oct. 11, 1983

[54] TERMINATOR CONNECTOR FOR SHIELDED CABLES

[75] Inventor: George W. Knecht, Brooklyn, N.Y.

[73] Assignee: Midland-Ross Corporation, Cleveland, Ohio

[21] Appl. No.: 324,811

[22] Filed: Nov. 25, 1981

[51] Int. Cl.[3] ..... H01A 4/66

[52] U.S. Cl. ..... 339/143 R; 339/146

[58] Field of Search ..... 339/14 R, 14 L, 163 R, 339/177 R, 177 E; 179/88 C, 89 C, 89 S

[56] References Cited

U.S. PATENT DOCUMENTS 3,099,506 7/1963 Tuchel ..... 339/143 R
4,032,205 6/1977 Taj ..... 339/14 L X
4,080,024 3/1978 Kroon ..... 339/14 R
4,377,320 3/1983 Lathrop et al. ..... 339/177 R

FOREIGN PATENT DOCUMENTS 674130 7/1979 U.S.S.R. ..... 174/88 C

*Primary Examiner*—Eugene F. Desmond
*Attorney, Agent, or Firm*—H. Duane Switzer

[57] ABSTRACT

A terminator connector for shielded cables includes a cylindrical base portion clampable against a cable shield, and a plurality of circumferentially-spaced spring fingers extending outwardly from one edge of the base portion for engaging a metal housing to ground the shield.

15 Claims, 10 Drawing Figures

A
B
C
D
E
4
4
12
14
16
18
20
22
26
28
30
32
34
36
40
42
50
52
54
56
60
62
64
66
68
70
72
74
76
82
84
86

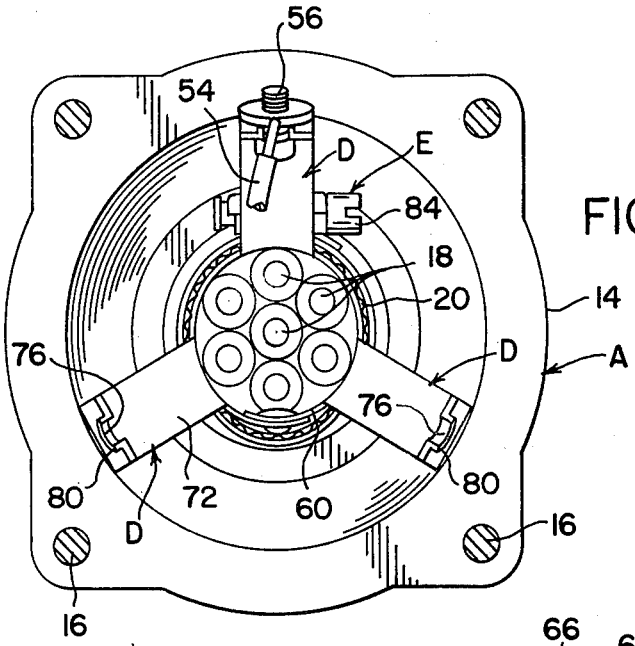
FIG. 4
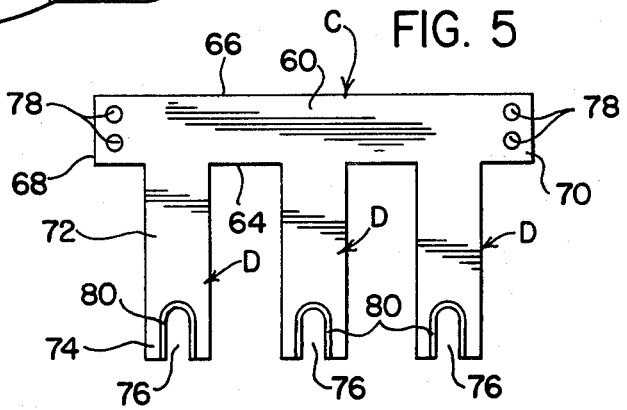
FIG. 5
FIG. 6
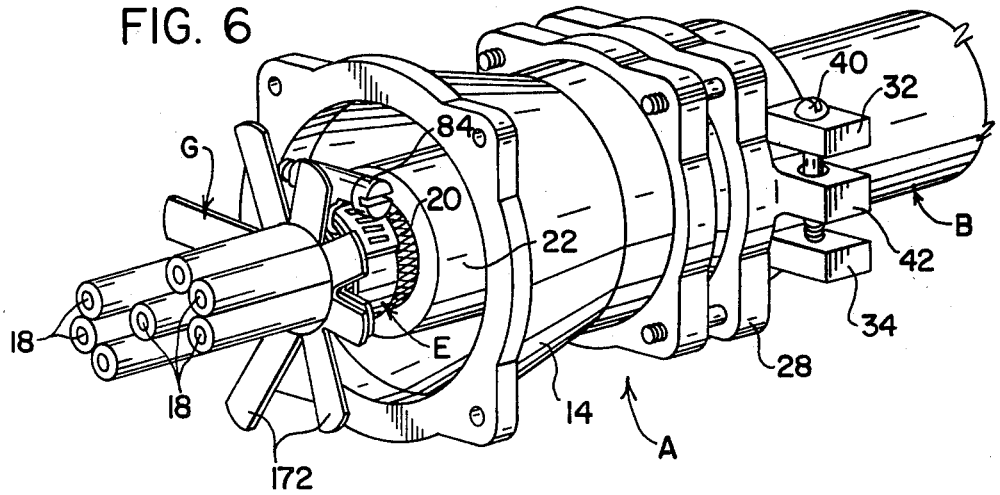

TERMINATOR CONNECTOR FOR SHIELDED CABLES

BACKGROUND OF THE INVENTION

This application relates to the art of ground connections and, more particularly, to such connections for the shield on shielded cable.

Flexible and portable power cable is commonly used in the data processing industry and stray radio frequency waves or other radiations may enter the cable conductors to cause errors in a memory or logic system of a data processor. In order to eliminate this problem, such cable is provided with an outer metal shield which may be braided, helically wrapped foil or helical flexible metal conduit. This metal shield prevents stray ratio frequency waves or other radiations from entering the cable conductors.

When an end portion of cable of the type described is connected at a termination housing such as a plug, connector, enclosure or splice, the metal shield of the cable must be grounded to the termination housing. It would be desirable to have a terminator connector which could be easily applied in the field for grounding the metal shield to a termination housing.

SUMMARY OF THE INVENTION

A terminator connector for grounding a metal shield on a cable to a termination housing includes a generally cylindrical base portion having a longitudinal axis, opposite circumferential edges and opposite end portions. A plurality of circumferentially-spaced spring fingers integral with the base portion extend outwardly from one edge thereof and outwardly from the longitudinal axis. The base portion is clamped in conductive engagement with an end portion of a cable shield and at least one of the spring fingers conductively engages an inner surface of a termination housing.

In one arrangement, the overlapping end portions of the base portion can be adjusted to overlap one another variable distances so that the cylindrical size of the base portion can be adjusted for use on cables of different size. In another arrangement, the overlapping end portions of the base portion may be fixedly secured together so the base portion does not exert a radially clamping force on the cable conductors.

In one arrangement, the free end portions of the fingers have screw receiving holes therein for securing the end portion of a finger against the termination housing and for connecting a ground wire thereto. The screw receiving holes may take many forms, and in one arrangement, such holes are in the form of slots extending generally axially of the fingers from the outer terminal ends thereof. The slots have peripheral edges which are deformed out of the plane of the fingers in a direction away from the longitudinal axis of the base portion. These deformed peripheral edges function in the manner of a lock washer when a finger end portion is screwed tightly against an inner surface of a termination housing.

In one embodiment, each finger has a first portion extending outwardly from the one edge of the base portion and away from the base portion longitudinal axis, and a second free end portion which is bent at an angle to the first portion back toward the longitudinal axis. This arrangement allows the outer end portion of a finger to extend generally parallel to an inner surface of the termination housing so it can be readily clamped against such inner surface by a screw.

The base portion of the terminator connector is positioned beneath the cable shield and a clamp band is positioned around the shield in axial alignment with the base portion. Tightening of the clamp band securely clamps the cable shield between the clamp band and the base portion of the connector.

It is a principal object of the present invention to provide an improved arrangement for grounding a cable shield to a termination housing.

It is also an object of the invention to provide an improved terminator connector which can be easily applied in the field for grounding a cable shield to a termination housing.

It is a further object of the invention to provide a terminator connector which is of very simple construction, and is very economical to manufacture.

BRIEF DESCRIPTION OF THE DRAWING

FIG. 4 is a cross-sectional elevational view taken generally on line 4—4 of FIG. 3;

FIG. 5 is a plan view of a strip which is used to form the terminator connector of FIG. 2;

FIG. 6 is a perspective illustration similar to FIG. 1 and showing another embodiment of a terminator connector;

DESCRIPTION OF PREFERRED EMBODIMENTS

Figures 1, 2, 3:
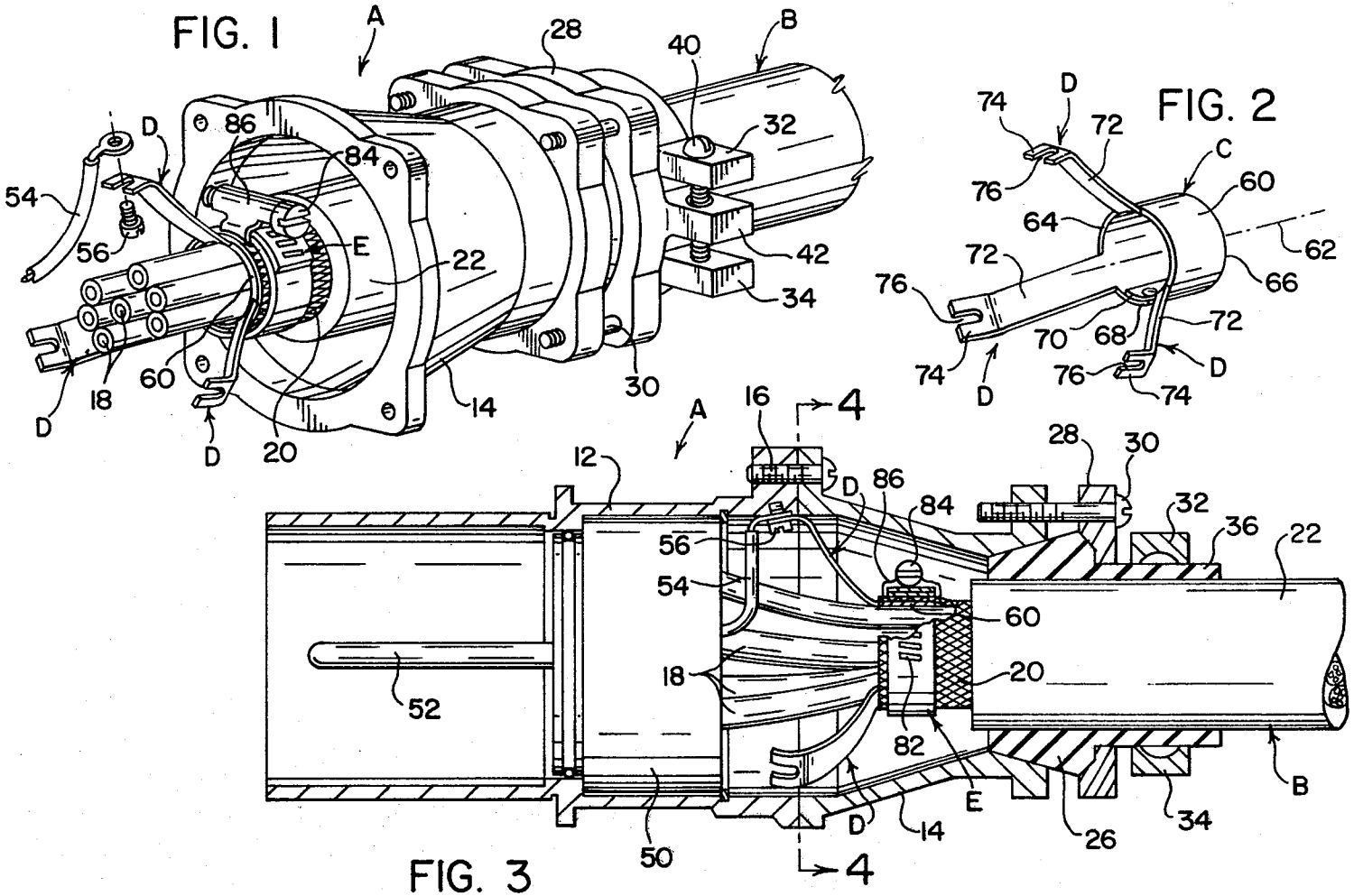
FIG. 1 is a perspective illustration of a termination housing having a cable extending therethrough and with the terminator connector of the present application secured to an end portion of the cable.
FIG. 2 is a perspective illustration of one embodiment of a terminator connector.
FIG. 3 is a side cross-sectional elevational view of a termination housing in the form of an electrical plug having the improved grounding arrangement of the present application incorporated therein.

With reference to the drawing, wherein the showings are for purposes of illustrating preferred embodiments of the invention only and not for purposes for limiting same, FIGS. 1 and 3 show a termination housing A including front and rear housing parts 12, 14 suitably secured together by fasteners 16 in a known manner.

An electrical cable B includes a plurality of individual conductors 18, each of which is individually surrounded by dielectric material. All of conductors 18 are surrounded by a tubular braided metal shield 20 which in turn is surrounded by a tubular sheath 22 of synthetic plastic material. Although shield 20 is shown as a braided metal tube, it will be recognized that this shield can also be in the form of foil wrapped around the conductors and can also be in the form of flexible metal conduit. Shield 20 prevents stray radio frequency waves or other radiations from entering conductors 18.

Cable B enters housing A through an elastomeric packing gland 26 at the rear end of rear housing part 14.

A packing gland retainer 28 is suitably secured to the rear end of rear housing part 14 by fasteners 30 which also causes packing gland 26 to radially contract on cable B. A two-piece cable clamp 32,34 is positioned around a rear extension 36 of packing gland 26. Suitable fasteners 40 move cable clamp parts 32,34 toward one another for tightly gripping cable B. Fasteners 40 also extend through suitable holes in ears 42 on packing gland retainer 28 to provide a strain relief for cable B so that pulling on cable B will not place a strain on the individual conductors and their connections to a plug or the like.

Plastic sheath 22 is cut-away along the end portion of cable B within housing A to expose shield, 20 and the shield is also cut-away to expose the individual conductors 18 and allowing same to be separated for connection in a plug body 50 to a plurality of plug prongs, only one of which is shown at 52 in FIG. 3. One of the plug prongs has a ground wire 54 connected thereto and such wire is connected to the interior of front housing part 12 by a screw 56 extending into a suitable tapped bore in the front housing part.

FIG. 2 shows a terminator connector C for use in grounding cable shield 20 to housing A. Terminator connector C includes a generally cylindrical base portion 60 having a longitudinal axis 62, opposite circumferential edges 64,66, and opposite end portions 68,70. A plurality of circumferentially-spaced spring fingers D integral with base portion 60 extend outwardly from circumferential edge 64 thereof and in a direction outwardly away from longitudinal axis 62. Each spring finger includes a first inner finger portion 72 and a second outer finger portion 74 which is bent relative to first portion 72 back toward axis 62. Each finger D has a suitable screw receiving hole therein in the form of an elongated slot 76 extending generally axially along the finger from the outer terminal end thereof. In the embodiment of FIG. 2, overlapping end portions 68,70 are suitably fixedly secured together as by rivets or the like so that the diameter of base portion 60 is not adjustable. FIG. 5 shows terminator connector C before it is formed into the shape shown in FIG. 2. Holes 78 at the opposite end portions 68,70 are for receiving rivets. As shown in FIG. 5, the peripheral edge of each screw receiving slot 56 is deformed out of the plane of each finger D as generally indicated at 80. When the connector is formed to the shape shown in FIG. 2, the deformed peripheral edges 80 are on the opposite sides of fingers D from longitudinal axis 62. Deformed peripheral edges 80 function in the manner of a lock washer when a screw is tightened against an outer portion of a finger.

Although it is possible to use other materials, it is highly advantageous to use stainless steel for terminator connector C because it will last a long time and corrosion is not a problem. In assembling terminator connector C, individual conductors 18 are extended through base portion 60 prior to connection of such conductors in plug body 50. Shield 20 is then loosened and pulled away for allowing base portion 60 to move beneath a terminal end portion of shield 20 as shown in FIG. 3. An adjustable clamp band E is then positioned over shield 20 in axial alignment with base portion 60. Tightening of the clamp band E securely clamps an end portion of shield 20 between base portion 60 and the clamp band. Obviously, the clamp band may take many forms, and in the arrangement shown comprises a flat strap having a plurality of diagonally transverse slots 82 therein for cooperation with a worm gear-type of screw 84 rotatably mounted in a sleeve 86 forming part of the clamp band. The cable is then rotated a sufficient amount to align one of spring fingers D with the hole for ground screw 56 in FIG. 3. Screw 56 is then tightened for securely connecting one of spring fingers D to the interior of housing A in good conductive relationship therewith. The plurality of fingers D are provided simply to insure that at least one finger will be close to the hole for screw 56 when the parts are assembled.

Figure 7:
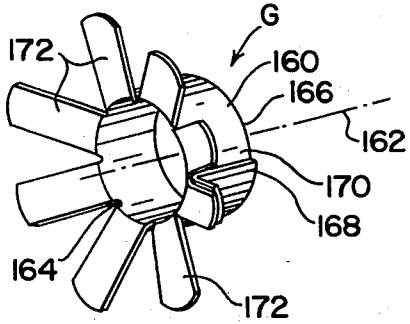
FIG. 7 is a perspective illustration of the terminator connector of FIG. 6.

FIGS. 6–10 show another embodiment wherein like parts are given like numerals. In this embodiment, as shown in FIG. 7, a terminator connector G of stainless steel includes a generally cylindrical base portion 160 having a longitudinal axis 162, opposite circumferential edges 164,166, and overlapping end portions 168,170. In this embodiment, end portions 168, 170 are not secured together so that adjustment in the diameter of base portion 160 is possible. A plurality of spring fingers 172 integral with base portion 160 extend outwardly from circumferential edge 164 thereof and outwardly from axis 162. Base portion 160 may be positioned beneath an end portion of shield 20 in the same manner as described with respect to FIG. 3 and clamp end E is then applied. However, it will recognized that base portion 160 of connector G can also be applied externally to the end portion of shield 20, particularly when connector G is applied to a flexible metallic conduit. Spring fingers 172 make firm conductive engagement with an inner surface of rear housing part 14.

In the arrangement of FIGS. 1–5, cable 5 is extended through housing part 14 as shown in FIG. 1 prior to assembly of front housing part 12. In the position of FIG. 1, terminator connector C is easily fixed to the cable in the manner described. The individual conductors 18 can then be fixed to the plug body 50, and ground wire 54 and one spring finger D can be secured to front housing part 12 by screw 56. Thereafter, cable B is pulled rearwardly to cause connector C to move toward rear housing part 14 until front housing part 12 is in proper position for attachment to rear housing part 14. Thereafter, packing gland retainer 28 and cable clamps 32,34 can be tightened.

Figure 8:
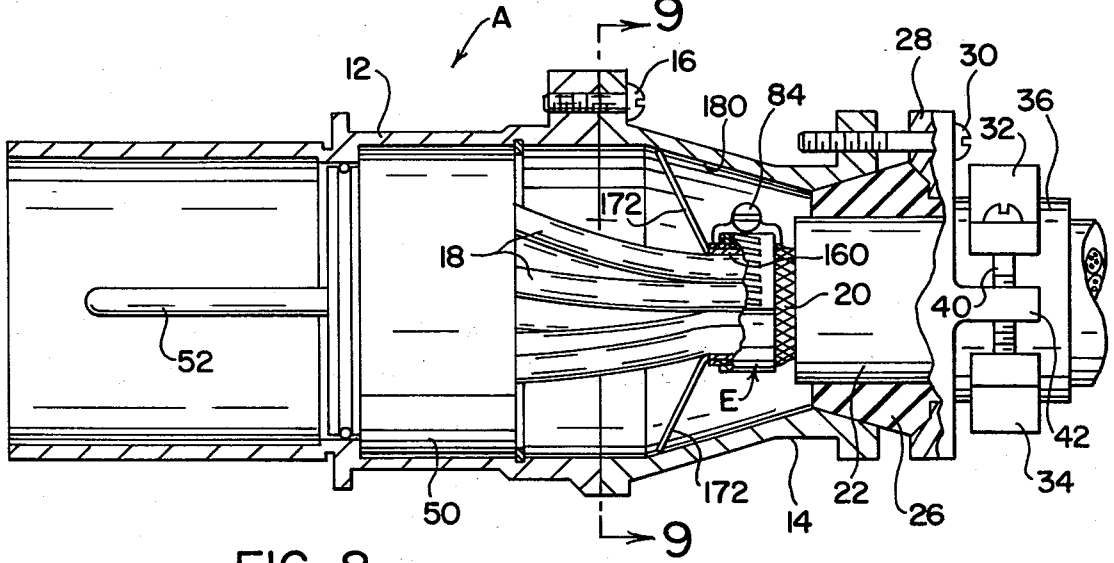
FIG. 8 is a side cross-sectional elevational view similar to FIG. 3 and showing the other embodiment of the terminator connector.
Figure 9:
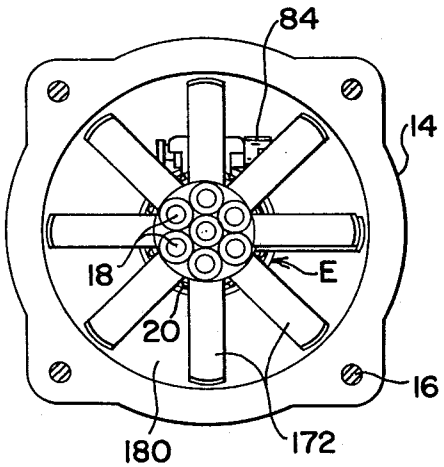
FIG. 9 is a cross-sectional elevational view taken generally on line 9—9 of FIG. 8.

In the arrangement of FIGS. 6–10, cable B is also extended through housing part 14 in the manner shown in FIG. 6 so that terminator connector G can easily be applied. Conductors 18 can then be connected with the plug body and cable B is then pulled to the right in FIGS. 6 and 8 for positioning front housing part 12 for attachment to rear housing part 14. During this movement of the cable, connector G moves into rear housing part 14 and the outer edges of spring fingers 172 firmly engage generally conical inner surface 180 on rear housing part 14. Thereafter, packing gland retainer 28 and cable clamps 32,34 can be tightened. Spring fingers 172 are under considerable bending stress in FIG. 8 so they firmly engage inner surface 180. The normal free positions for fingers 172 is generally perpendicular to axis 162 and, as shown in FIG. 8, fingers 172 are substantially bent toward axis 162 from their normal free positions.

Figure 10:
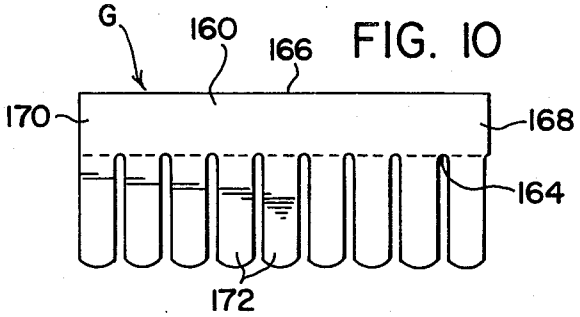
FIG. 10 is a plan view of a metal strip used to form the terminator connector of FIG. 7.

FIG. 10 shows terminator connector G before it is formed into the shape shown in FIG. 7. The connector is readily formed simply by stamping a flat sheet of stainless steel to the shape shown in FIG. 10 and then forming same into the shape shown in FIG. 7.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A terminator connector for grounding a conductive shield on a cable to a housing comprising: a generally cylindrical base portion having a longitudinal axis, opposite circumferential edges and overlapping ends, and a plurality of spring fingers extending outwardly from one of said edges away from said axis in circumferentially-spaced relationship to one another, said base portion being clampable against a conductive cable shield and at least one of said fingers being engageable with a conductive housing at an end portion of the cable.

2. The connector of claim 1 wherein said base portion is variable in size by varying the overlapping length of said ends.

3. The connector of claim 1 wherein said overlapping ends of said base portion are secured together.

4. The connector of claim 1 wherein said fingers have free end portions and further including screw receiving holes in said free end portions.

5. The connector of claim 4 wherein said fingers have free terminal ends and said screw receiving holes comprise slots extending from said free terminal ends and along said free end portions generally axially of said fingers.

6. The connector of claim 5 wherein said slots have peripheral edges which are deformed outwardly of the plane of said fingers in a direction away from said axis.

7. The connector of claim 1 wherein each said finger has a first portion extending outwardly from said one edge and away from said axis, and a second free end portion bent at an angle to said first portion back toward said axis.

8. The connector of claim 7 wherein each said free end portion has a screw receiving slot therein.

9. In a termination for a terminal end portion of a cable having a conductive shield for shielding conductors in said cable against stray radio frequency radiations and the like, a metal housing surrounding said cable terminal end portion and having an inner surface portion spaced outwardly from said cable, a terminator connector having a generally cylindrical base portion clamped against said shield and including a longitudinal axis and opposite circumferential edges, a plurality of elongated spring fingers extending outwardly from one of said edges and away from said axis in circumferentially-spaced relationship to one another, and at least one of said fingers being in conductive engagement with said inner surface of said housing.

10. The termination of claim 9 wherein said base portion is positioned beneath said shield and a clamp band around said shield in alignment with said base portion.

11. The termination of claim 9 wherein said connector is stainless steel.

12. The termination of claim 9 wherein said base portion includes overlapping ends.

13. The termination of claim 12 wherein said overlapping ends are secured together.

14. The termination of claim 9 wherein each said finger has a first finger portion extending outwardly from said base portion and a second finger terminal end portion bent relative to said first finger portion back toward said axis.

15. The termination of claim 14 wherein each said finger terminal end portion has a screw receiving hole therein.

* * * * *